US009826589B1

(12) United States Patent
Gao et al.

(10) Patent No.: US 9,826,589 B1
(45) Date of Patent: Nov. 21, 2017

(54) LED DEVICE

(71) Applicant: XIAMEN ECO LIGHTING CO. LTD., Xiamen (CN)

(72) Inventors: Yanzeng Gao, Xiamen (CN); Minghao Wu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/397,717

(22) Filed: Jan. 3, 2017

(30) Foreign Application Priority Data

Sep. 26, 2016 (CN) ..... 2016 1 0849247

(51) Int. Cl.
*H05B 33/08* (2006.01)

(52) U.S. Cl.
CPC ..... *H05B 33/0845* (2013.01); *H05B 33/083* (2013.01); *H05B 33/0815* (2013.01); *H05B 33/0827* (2013.01)

(58) Field of Classification Search
None
See application file for complete search history.

(56) References Cited

U.S. PATENT DOCUMENTS

2013/0002141 A1* 1/2013 Lee ..... H05B 33/083 315/152
2014/0184080 A1* 7/2014 Rybicki ..... H05B 33/0845 315/122

* cited by examiner

*Primary Examiner* — Jany Richardson
(74) *Attorney, Agent, or Firm* — Chun-Ming Shih

(57) ABSTRACT

An LED device is disclosed. The LED device comprises a PWM controller. A phase dimmer produces a regulated signal. The PWM controller converts the regulated signal into a switching signal in a series mode and optionally converts the rectified signal into the switching signal in the parallel mode.

20 Claims, 9 Drawing Sheets

LED DEVICE

FIELD OF THE INVENTION

The invention is related to the field of illumination, in particular to the field of LED device.

BACKGROUND OF THE INVENTION

LED light sources has advantages of high luminous efficiency, low heat generation, electricity saving, and long lifetime, thus having more and more wide applications. LED lights will gradually replace conventional illuminative lamps like incandescent lamps and halogen lamps. With the development of LED lights, LED lights are driven toward the trend of structural miniaturization. Common LED light driving circuits in the current market use an electrolytic capacitor for filtering after rectifications of voltage inputs, and inductors or transformers are also needed to be used in circuits.

Because the large volume of electrolytic capacitors occupy a larger space of driving circuits, the driving circuits are difficult to be further miniaturized. Also, the lifetime of electrolytic capacitors is greatly influenced by ambient temperature of the space of driving circuits, making electrolytic capacitors have premature failures, resulting in the shortened lifetime of the whole light. The larger volume of inductors and transformers also results in difficulties in miniaturizing driving structures. In addition, an efficient dimming control of an LED device is also very important for modern illumination applications.

SUMMARY OF THE INVENTION

One objective of the invention is to provide an efficient dimming control for an LED device.

Another objective of the invention is to provide a dimming control that can use a phase dimmer to control PWM switching for an LED device.

Still another objective of the invention is to provide a dimming control that can help an LED device be suitable for a traditional phase dimmer control.

According to one aspect of the invention, an LED device is disclosed. The LED device processes a regulated signal from a phase dimmer. The phase dimmer cuts a portion of a phase of an input signal and outputting the regulated signal. The LED device comprises a first LED light string, a second LED light string, a rectifying module, and a control unit. The rectifying module rectifies the regulated signal and outputs a rectified signal. The control unit comprises a PWM controller. The control unit receives the rectified signal. The control unit compares the rectified signal with a predetermined voltage level.

When a voltage level of the rectified signal is greater than the predetermined voltage level, the PWM controller converts the rectified signal into a switching signal according to the rectified signal and the control unit connects the first LED light string and the second LED light string in series.

When the voltage level of the rectified signal is lower than the predetermined voltage level, the PWM controller stops converting the rectified signal into the switching signal and the control unit connects the first LED light string and the second LED light string in parallel.

According to another aspect of the invention, an LED device is disclosed. The LED device processes a regulated signal from a phase dimmer. The phase dimmer cuts a portion of a phase of an input signal and outputting the regulated signal.

The LED device comprises a first LED light string, a second LED light string, a rectifying module, and a control unit. The rectifying module rectifies the regulated signal and outputs a rectified signal.

The control unit receives the rectified signal. The control unit has a parallel mode and a series mode. The control unit comprises a PWM controller. The PWM controller generates a switching signal based on at least a parameter calculated from the rectified signal.

When the control unit is in the parallel mode, the control unit connects the first LED light string and the second LED light string in parallel. When the control unit is in the series mode, the control unit connects the first LED light string and the second LED light string in series.

According to still another aspect of the invention, an LED device is disclosed. The LED device processes a regulated signal from a phase dimmer. The phase dimmer cuts a portion of a phase of an input signal and outputting the regulated signal. The LED device comprises a first LED light string, a first PWM transistor, a second LED light string, a second PWM transistor, a rectifying module, and a control unit. The first PWM transistor is connected to the first LED light string. The second PWM transistor is connected to the second LED light string. The rectifying module rectifies a regulated signal and outputs a rectified signal.

The control unit comprises a PWM controller and a voltage input detection unit. The control unit receives the rectified signal. The PWM controller produces a PWM signal to control the first PWM transistor and the second PWM transistor. The voltage input detection unit compares the rectified signal with a predetermined voltage level.

When a voltage level of the rectified signal is greater than the predetermined voltage level, the first LED light string and the second LED light string shares the first PWM transistor. When the voltage level of the rectified signal is lower than the predetermined voltage level, the first LED light string and the second LED light string do not share the first PWM transistor.

The LED device according to the embodiments mentioned above can have an efficient dimming control. The dimming control can use a phase dimmer to control PWM switching for the LED device. The dimming control can help an LED device be suitable for a traditional phase dimmer control.

DETAILED DESCRIPTION OF THE INVENTION

Figure 1:
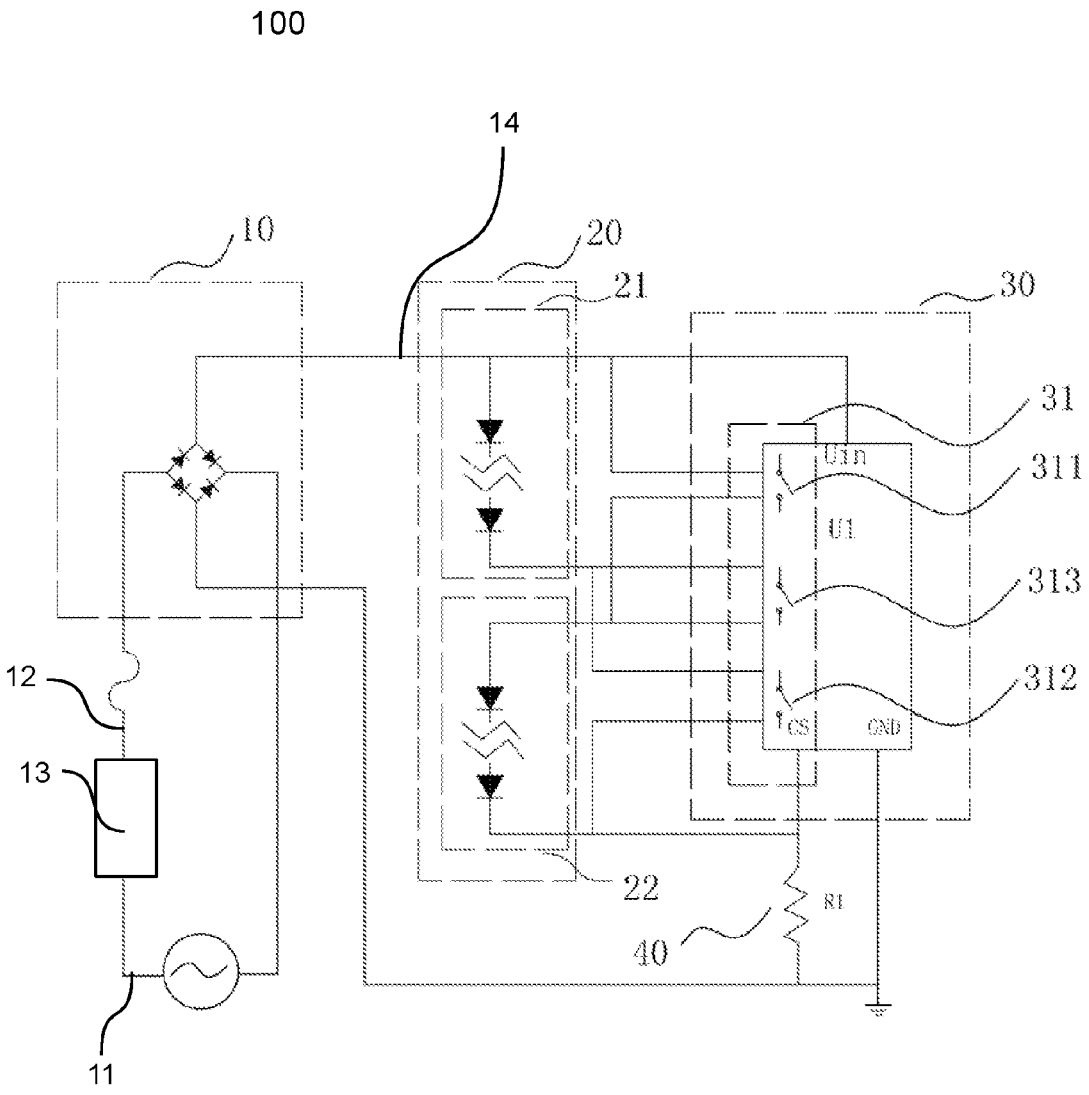
FIG. 1 shows an embodiment of an LED device.
Figure 2:
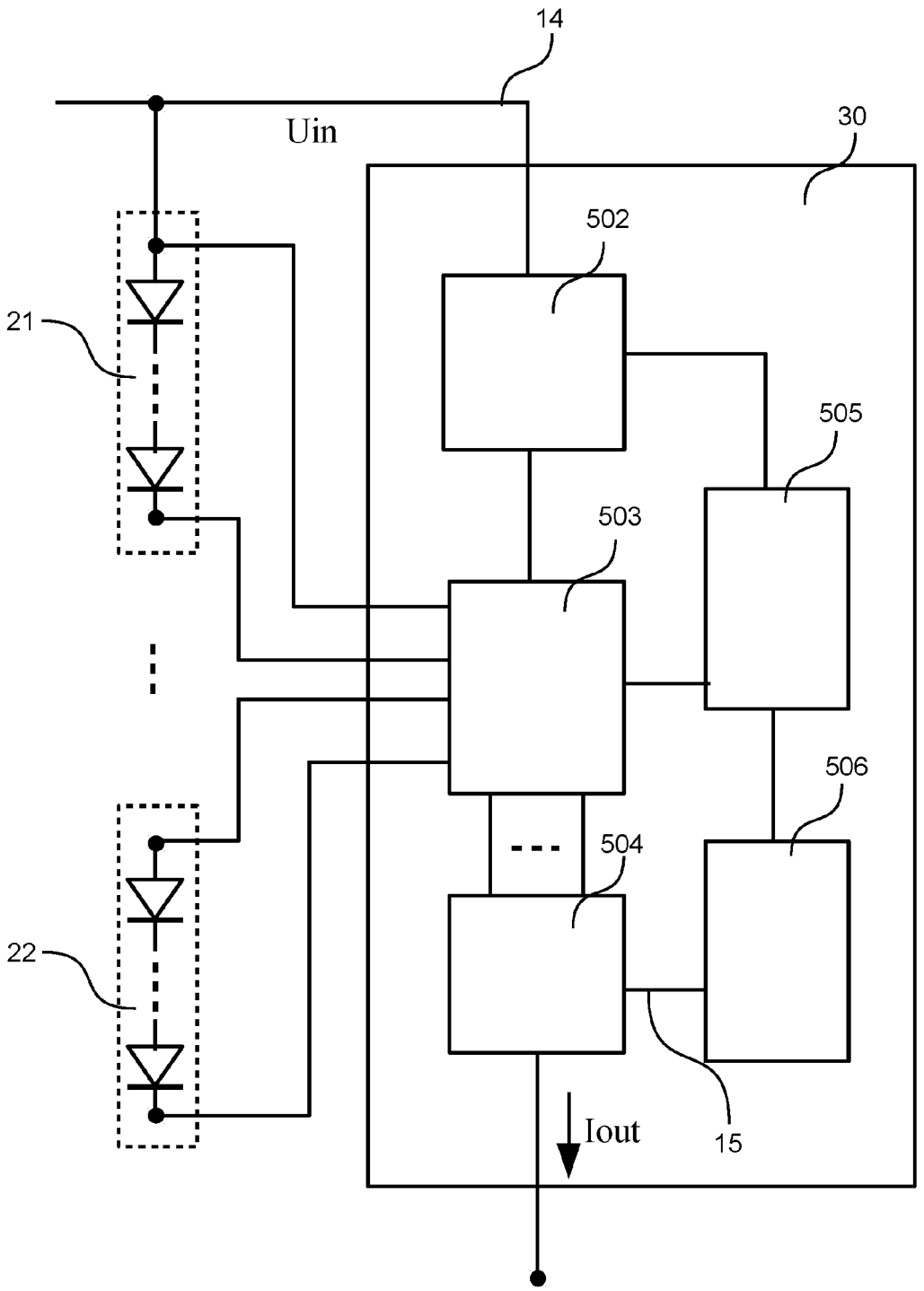
FIG. 2 shows another embodiment of an LED device.
Figure 3:
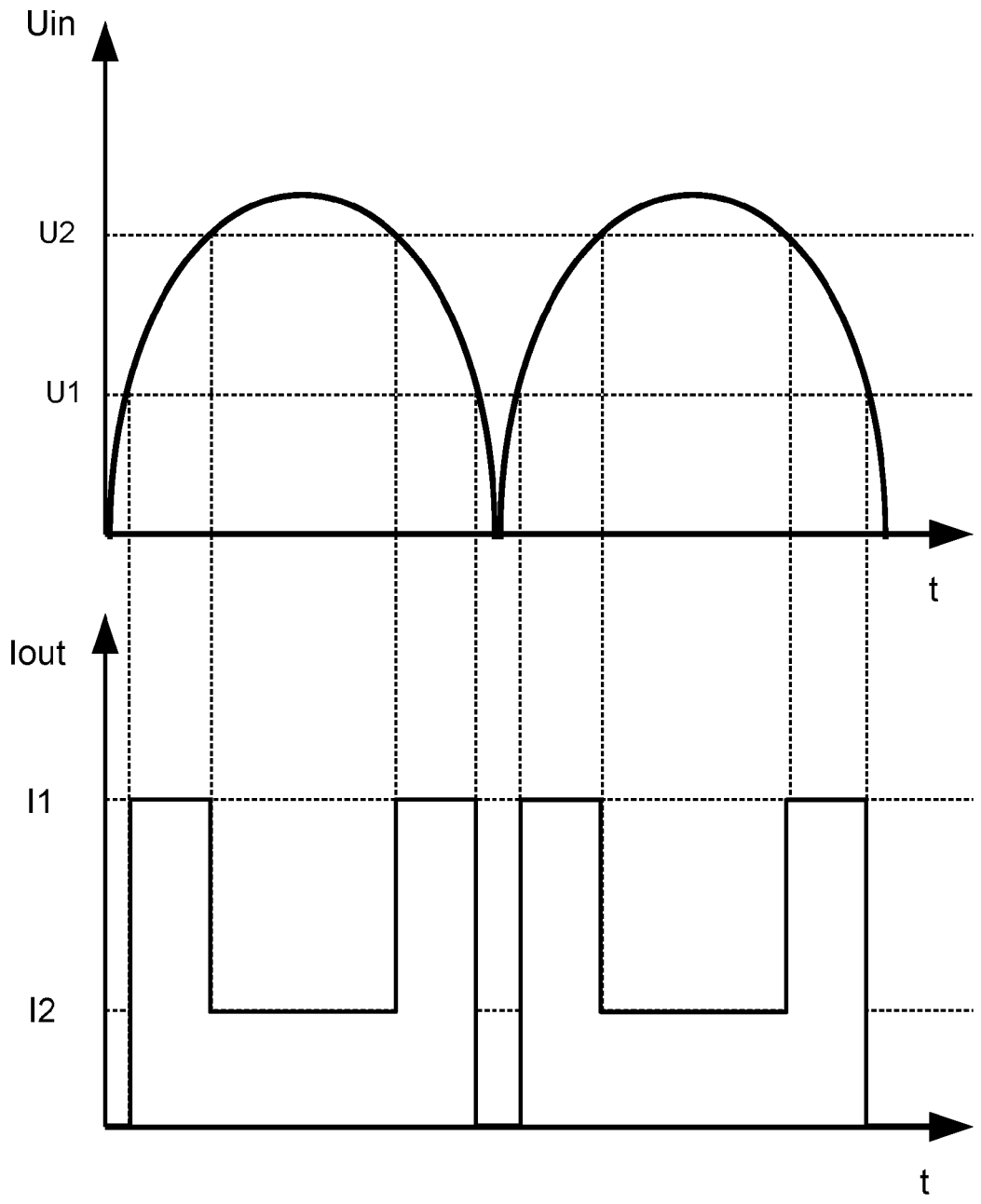
FIG. 3 shows waveforms of a rectified signal and an output current.
Figure 4:
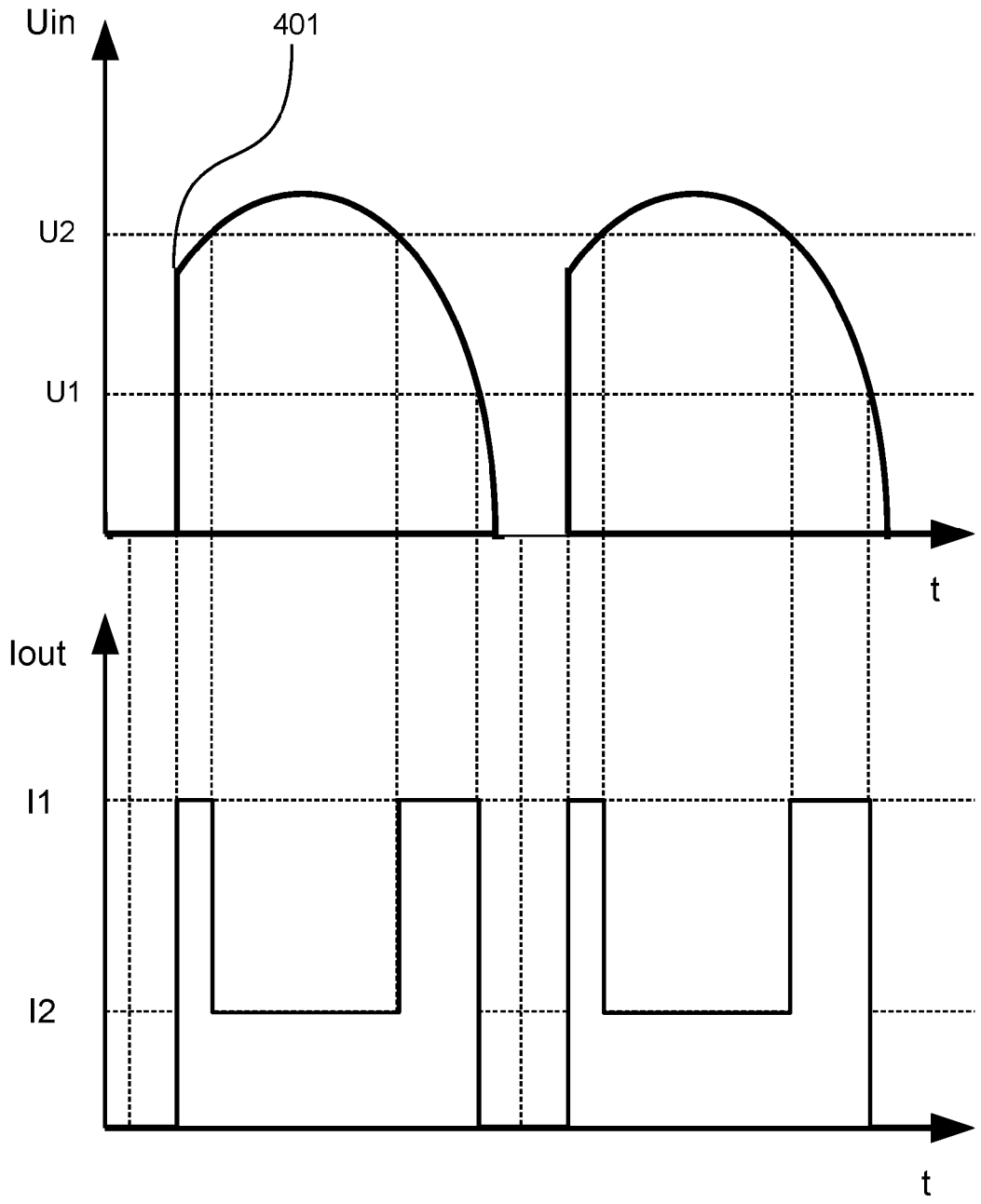
FIG. 4 shows waveforms of a rectified signal and an output current when a portion of a phase is cut.
Figure 5:
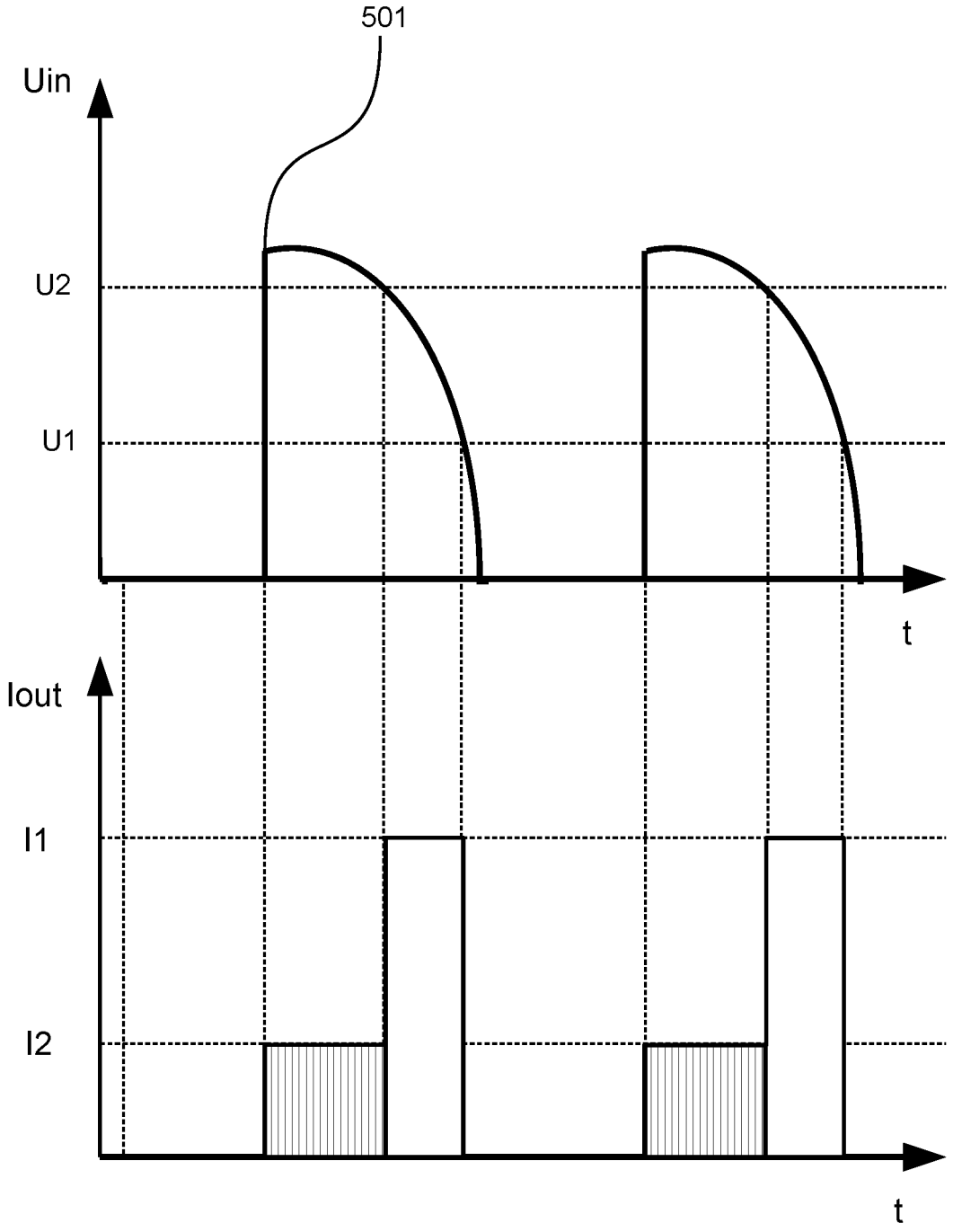
FIG. 5 shows waveforms of a rectified signal and an output current when another portion of a phase is cut.
Figure 6:
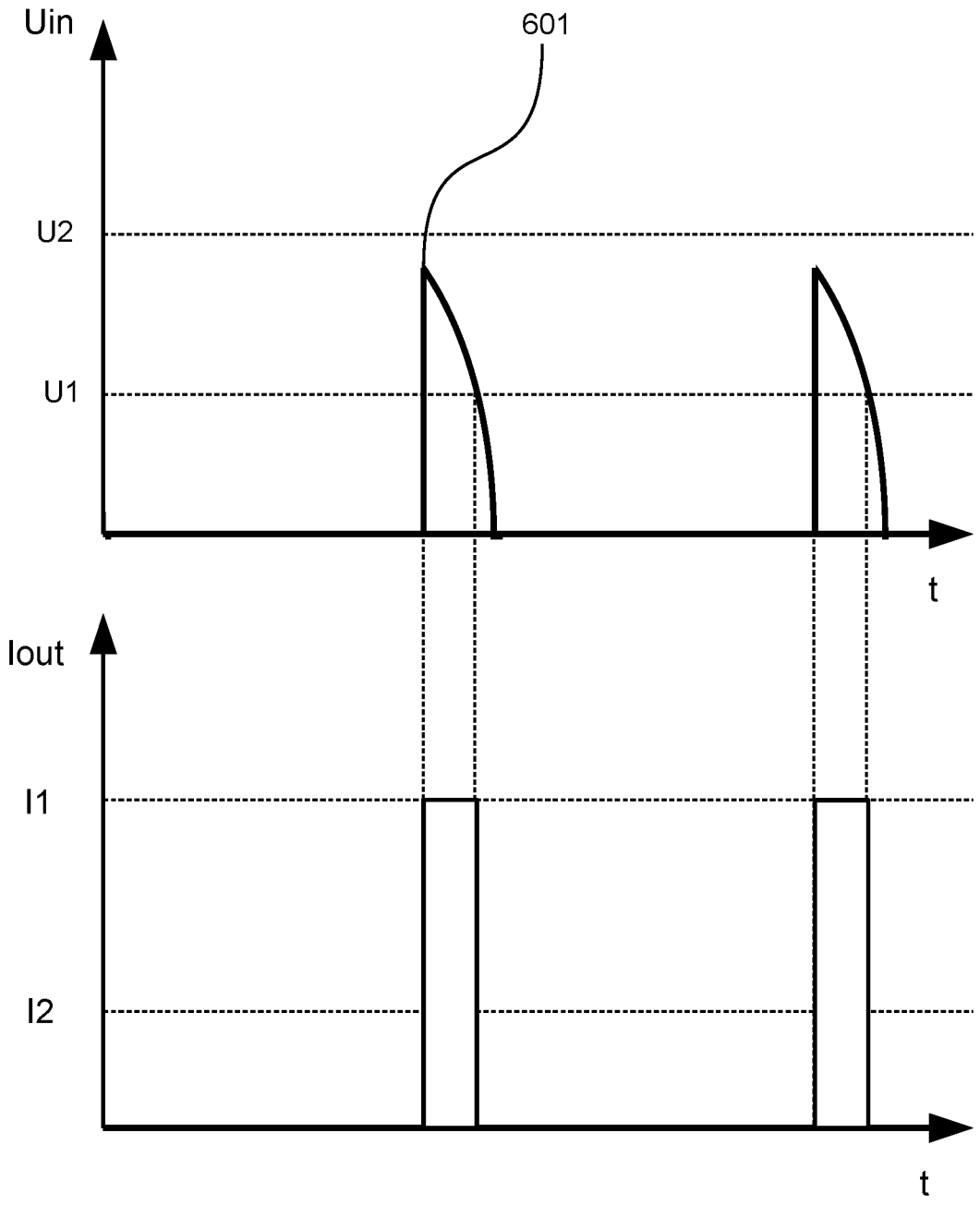
FIG. 6 shows waveforms of a rectified signal and an output current when another portion of a phase is cut.
Figure 7:
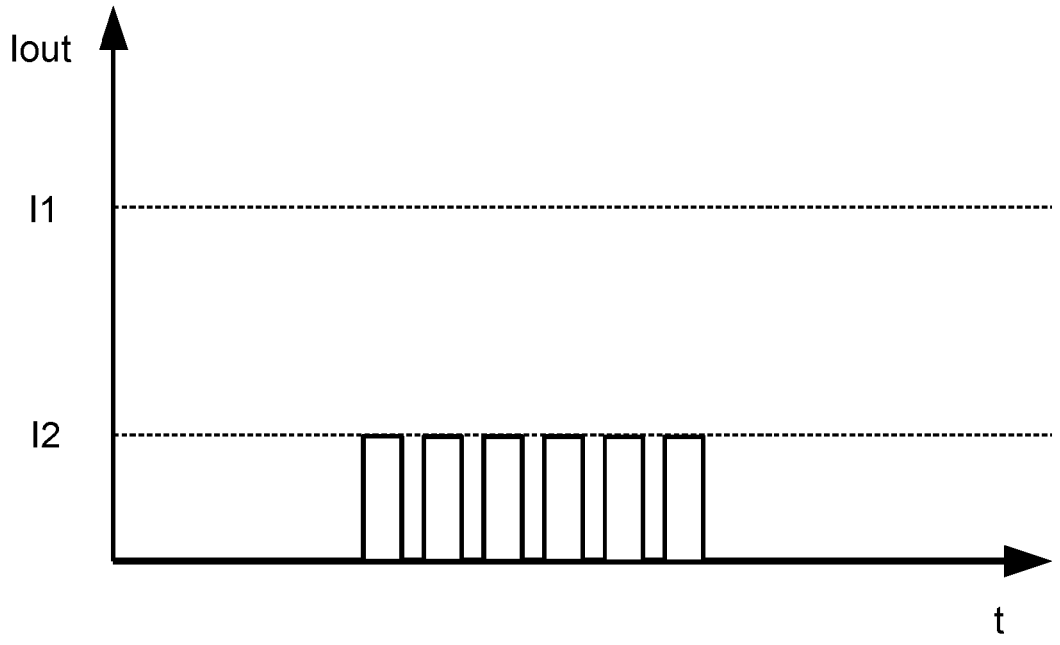
FIG. 7 shows an example of an output current when a switching signal is applied.
Figure 8:
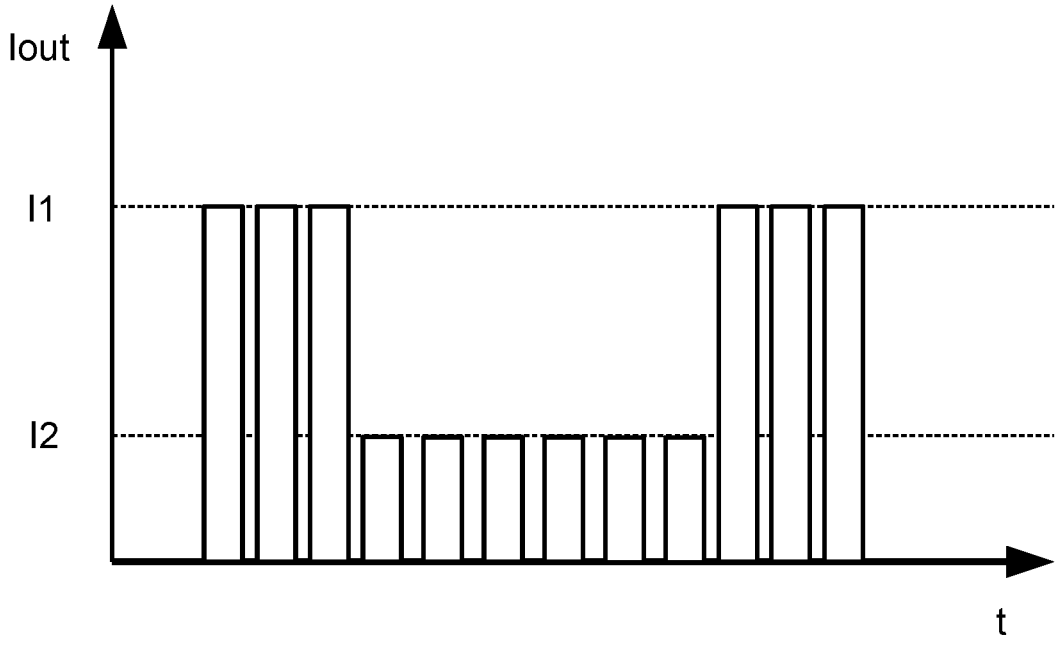
FIG. 8 shows another example of an output current when a switching signal is applied.
Figure 9:
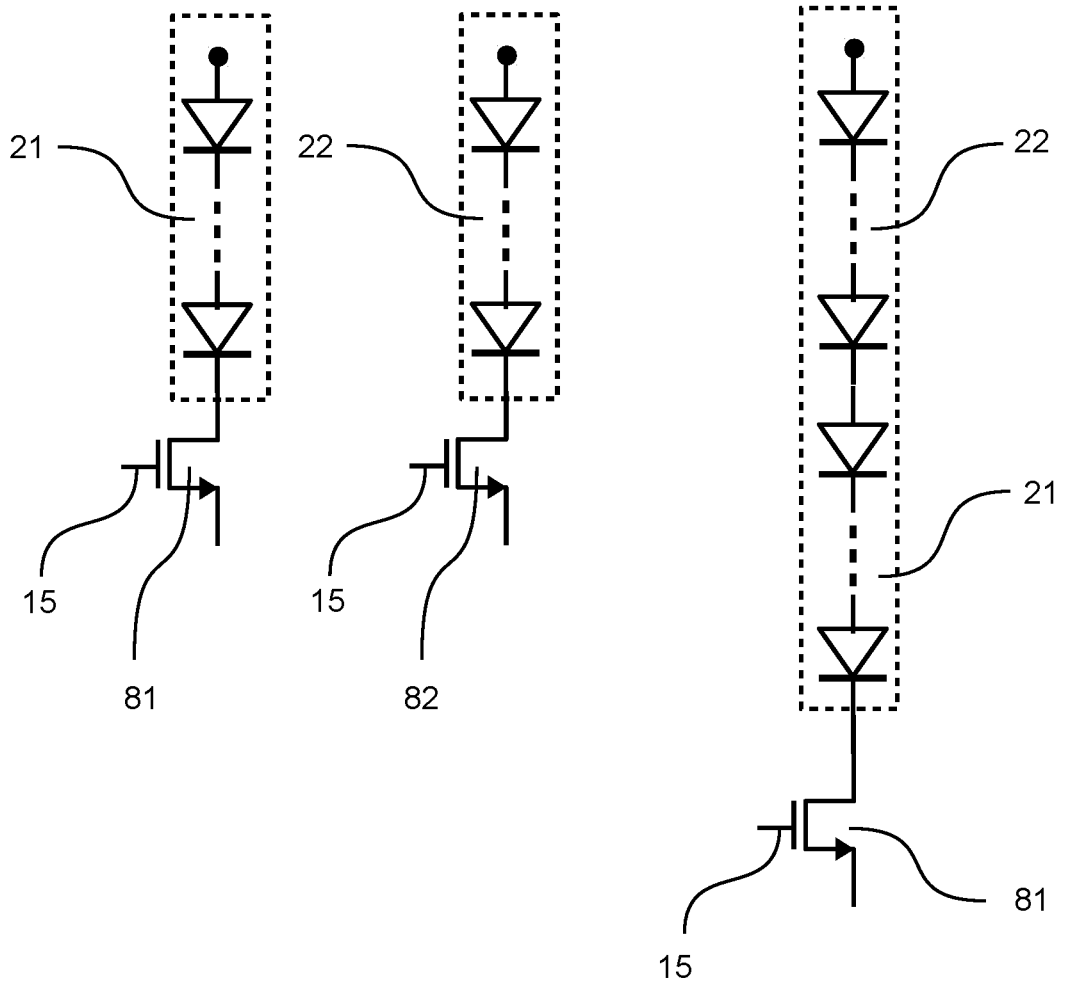
FIG. 9 shows examples of PWM transistors connecting to LED light strings.

FIG. 1 shows an embodiment of an LED device. FIG. 2 shows another embodiment of an LED device. FIG. 3 shows waveforms of a rectified signal and an output current. FIG. 4 shows waveforms of a rectified signal and an output current when a portion of a phase is cut. FIG. 5 shows waveforms of a rectified signal and an output current when another portion of a phase is cut. FIG. 6 shows waveforms of a rectified signal and an output current when another portion of a phase is cut. FIG. 7 shows an example of an output current when a switching signal is applied. FIG. 8 shows another example of an output current when a switching signal is applied. FIG. 9 shows examples of PWM transistors connecting to LED light strings.

According to an embodiment, with reference to FIG. 1 and FIG. 2, an LED device 100 comprises a first LED light string 21, a second LED light string 22, a rectifying module 10, and a control unit 30. The LED device 100 processes a regulated signal 12 from a phase dimmer 13. The phase dimmer 13 cuts a portion of a phase of an input signal 11 and outputting the regulated signal 12.

The rectifying module 10 rectifies an regulated signal 12 and outputting a rectified signal 14. The control unit 30 comprises a PWM controller 506. The control unit 30 receives the rectified signal 14. The control unit 30 compares the rectified signal 14 with a first predetermined voltage level U1 and a second predetermined voltage level U2. The first LED light string 21 has a first turn-on voltage. The second LED light string 22 has a second turn-on voltage. The first predetermined voltage level U1 can be any one of the first turn-on voltage or the second turn-on voltage. The second predetermined voltage level U2 is at least a sum of the first turn-on voltage and the second turn-on voltage. In some embodiments, the first turn-on voltage is the same as the second turn-on voltage.

With reference to FIG. 1, FIG. 2, FIG. 3, FIG. 4, FIG. 5 and FIG. 6, when a voltage level of the rectified signal 14 is greater than the first predetermined voltage level U1 but lower than the second predetermined voltage level U2, the control unit 30 connects the first LED light string 21 and the second LED light string 22 in parallel.

When the voltage level of the rectified signal 14 is greater than the predetermined voltage level U2, the PWM controller 506 converts the rectified signal 14 into a switching signal 15 according to the rectified signal 14 and the control unit 30 connects the first LED light string 21 and the second LED light string 22 in series.

In some embodiments, when the voltage level of the rectified signal 14 is lower than the second predetermined voltage level U2, the PWM controller 506 stops converting the rectified signal 14 into the switching signal 15 and the control unit 30 connects the first LED light string 21 and the second LED light string 22 in parallel.

In some embodiments, the phase dimmer 13 is a leading-edge dimmer. In some embodiments, the phase dimmer 13 is a silicon controlled rectifier. In some embodiments, the phase dimmer 13 is a TRIAC (triode for alternating current). In some embodiments, the phase dimmer 13 is a trailing edge dimmer. In some embodiments, the phase dimmer 13 is a MOS dimmer.

The control unit 30 further comprises a switch assembly 31. In some embodiments, the switch assembly 31 can be a switch assembly 503. When a voltage level of the rectified signal 14 is higher than a first predetermined voltage level U1 and lower than the second predetermined voltage level U2, the switch assembly 503 connects the first LED light string 21 and the second LED light string 22 in parallel. When the voltage level of the rectified signal 14 is higher than the second predetermined voltage level U2, the switch assembly 503 connects the first LED light string 21 and the second LED light string 22 in series.

In some embodiments, the switch assembly 31 comprises a first switch 311, a second switch 312, and a third switch 313. With reference to FIG. 1, FIG. 2, and FIG. 3, when the voltage level of the rectified signal 14 is higher than the first predetermined voltage level U1 and lower than the second predetermined voltage level U2, the first switch 311 is connected, the second switch 312 is connected, and the third switch 313 is disconnected so that the first LED light string 21 and the second LED light string 22 are connected in parallel. When the voltage level of the rectified signal 14 is higher than the second predetermined voltage level U2, the first switch 311 is disconnected, the second switch 312 is disconnected, and the third switch 131 is connected so that the first LED light string 21 and the second LED light string 22 are connected in series.

With reference to FIG. 3, in some embodiments, when the first LED light string 21 and the second LED light string 22 are connected in parallel, a driving current I1 is outputted from the control unit 30. When the first LED light string 21 and the second LED light string 22 are connected in series, a driving current I2 is outputted from the control unit 30. In this case, the driving current I1 is double the driving current I2 because each of the first LED light string 21 and the second LED light string 22 has the same constant driving current.

With reference to FIG. 3, when the rectified signal 14 is lower than the first predetermined voltage level U1, there is no driving current flowing through the first LED light string 21 and the second LED light string 22. Therefore, when the cut portion of a phase of the rectified signal 14 is lower than the first predetermined voltage level U1, it does not affect a brightness of the LED device 100.

With reference to FIG. 4, a portion of a rising phase of the rectified signal 14 is cut at a point 401 by the phase dimmer 13, forming a leading-edge cutting effect. The voltage level of the point 401 is higher than the first predetermined voltage level U1 and lower than the second predetermined voltage level U2. The corresponding driving current is also cut, so the brightness is represented by remaining phase of the rectified signal 14. In some embodiments, an average voltage value of the rectified signal 14 is proportional to the brightness of the LED device.

With reference to FIG. 5, a portion of a rising phase of the rectified signal 14 is cut at a point 501 by the phase dimmer 13, forming a leading-edge cutting effect. The voltage level of the point 501 is higher than the second predetermined voltage level U2. The corresponding driving current is also cut, so the brightness is represented by remaining phase of the rectified signal 14. In some embodiments, a duty cycle of the driving current is proportional to the brightness of the LED device 100.

With reference to FIG. 6, a portion of a rising phase of the rectified signal 14 is cut at a point 601 by the phase dimmer 13, forming a leading-edge cutting effect. The voltage level of the point 601 is higher than the first predetermined voltage level U1 and lower than the second predetermined voltage level U2. The corresponding driving current is also cut, so the brightness is represented by remaining phase of the rectified signal 14. In some embodiments, an average voltage value of the rectified signal 14 is proportional to the brightness of the LED device.

According to another embodiment, with reference to FIG. 1, FIG. 2, FIG. 3, and FIG. 4, an LED device 100 is disclosed. The LED device 100 processes a regulated signal 12 from a phase dimmer 13. The phase dimmer 13 cuts a portion of a phase of an input signal 11 and outputting the regulated signal 12. The LED device 100 comprises a first LED light string 21, a second LED light string 22, a rectifying module 10, and a control unit 30.

The rectifying module 10 rectifies a regulated signal 12 and outputs a rectified signal 14. The control unit 30 receives the rectified signal 14. The control unit 30 has a parallel mode and a series mode. The control unit 30 comprises a PWM controller 506. The PWM controller 506 generates a switching signal 15 based on at least a parameter calculated from the rectified signal 14.

When the control unit 30 is in the parallel mode, the control unit 30 connects the first LED light string 20 and the second LED light string 21 in parallel. When the control unit 30 is in the series mode, the control unit 30 connects the first LED light string 20 and the second LED light string 21 in series.

In some embodiments, the parameter is a root mean square value calculated from the rectified signal 14. In some embodiments, the parameter is an average voltage value calculated from the rectified signal 14. In some embodiments, the PWM controller 506 outputs the switching signal 15 only when the control unit 30 is in the series mode.

In some embodiments, the PWM controller 506 outputs the switching signal 15 in both the parallel mode and the series mode. In some embodiments, a duty cycle of the switching signal 15 is the same as a duty cycle of the rectified signal 14.

According to another embodiment, with reference to FIG. 1, FIG. 2, FIG. 3, FIG. 4, and FIG. 9, an LED device 100 comprises a first LED light string 21, a first PWM transistor 81, a second LED light string 22, a second PWM transistor 82, a rectifying module 10, and a control unit 30. The LED device 100 processes a regulated signal 12 from a phase dimmer 13. The phase dimmer 13 cuts a portion of a phase of an input signal 11 and outputting the regulated signal 12.

The first PWM transistor 81 is connected to the first LED light string 21. The second PWM transistor 82 is connected to the second LED light string 22. The rectifying module 10 rectifies a regulated signal 12 and outputs a rectified signal 14.

The control unit 30 comprises a PWM controller 506 and a voltage input detection unit 502. The control unit 30 receives the rectified signal 14. The PWM controller 506 produces a PWM signal 15 to control the first PWM transistor 81 and the second PWM transistor 82. The voltage input detection unit 502 compares the rectified signal 14 with a predetermined voltage level U2.

When a voltage level of the rectified signal 14 is greater than the predetermined voltage level U2, the first LED light string 21 and the second LED light string 22 shares the first PWM transistor. When the voltage level of the rectified signal 14 is lower than the predetermined voltage level U2, the first LED light string 21 and the second LED light string 22 do not share the first PWM transistor.

In some embodiments, the predetermined voltage level U2 is a second predetermined voltage level U2. The control unit 30 further comprises a switch assembly 503. When a voltage level of the rectified signal 14 is higher than a first predetermined voltage level U1 and lower than the second predetermined voltage level U2, the switch assembly 503 connects the first LED light string and the second LED light string in parallel. When the voltage level of the rectified signal 14 is higher than the second predetermined voltage level U2, the switch assembly 503 connects the first LED light string 21 and the second LED light string 22 in series.

In some embodiments, the control unit 30 further comprises a regulator module 504 for generating a constant current for each of the first LED light string 21 and the second LED light string 22. In some embodiments, the control unit 30 further comprises a logic circuit 505 for controlling the voltage input detection unit 502, the switch assembly 503, and the regulator module 504. In some embodiments, the PWM controller 506 generates the switching signal 15 based on at least a parameter calculated from the rectified signal 14. The regulator module 504 can provide a proper current value so that each of the first LED light string 21 and the second LED light string 22 can have a constant current either in the parallel mode or in the series mode.

In some embodiments, the parameter is a root mean square value calculated from the rectified signal 14. In some embodiments, the parameter is an average voltage value calculated from the rectified signal 14. In some embodiments, a duty cycle of the switching signal 15 is the same as a duty cycle of the rectified signal 14. In some embodiments, the second PWM transistor 82 is turned off when the voltage level of the rectified signal 14 is greater than the predetermined voltage level U2.

With reference to FIG. 9, in some embodiments, the PWM signal 15 controls on/off states of the PWM transistors 81 and 82. The corresponding currents flowing through the first LED light string 21 and the second LED light string 22 can thus be controlled. In some embodiments, when the first LED light string 21 and the second LED light string 22 are connected in parallel, two PWM transistors 81 and 82 are used to control two LED light strings separately. However, when the first LED light string 21 and the second LED light string 22 are connected in series, only one PWM transistor 81 is used to control the driving current. In this case, the first LED light string 21 and the second LED light string 22 shares the PWM transistor 81.

With reference to FIG. 5 and FIG. 7, in some embodiments, the PWM signal 15 is produced only when the control unit 30 is in the series mode. The alternating driving current with a current value 12 can be produced. The duty cycle of the alternating driving current is proportional to the brightness of the LED device.

With reference to FIG. 5 and FIG. 8, in some embodiments, the PWM signal 15 is produced both in the series mode and in the parallel mode. The alternating driving current with a current value I1 and another current value 12 can be produced. The duty cycle of the alternating driving current is proportional to the brightness of the LED device.

What is claimed is:

1. An LED device, for processing a regulated signal from a phase dimmer, the phase dimmer cutting a portion of a phase of an input signal and outputting the regulated signal, the LED device comprising:

a first LED light string;

a second LED light string;

a rectifying module, for rectifying the regulated signal and outputting a rectified signal; and a control unit, the control unit comprising a PWM controller, the control unit receiving the rectified signal, the control unit comparing the rectified signal with a predetermined voltage level;

wherein when a voltage level of the rectified signal is greater than the predetermined voltage level, the PWM controller converts the rectified signal into a switching signal according to the rectified signal and the control unit connects the first LED light string and the second LED light string in series; and wherein when the voltage level of the rectified signal is lower than the predetermined voltage level, the PWM controller stops converting the rectified signal into the switching signal and the control unit connects the first LED light string and the second LED light string in parallel.

2. The LED device of claim 1, wherein the phase dimmer is a leading-edge dimmer.

3. The LED device of claim 1, wherein the phase dimmer is a trailing edge dimmer.

4. The LED device of claim 1, wherein the predetermined voltage level is a second predetermined voltage level, the control unit further comprises a switch assembly, when the voltage level of the rectified signal is higher than a first predetermined voltage level and lower than the second predetermined voltage level, the switch assembly connects the first LED light string and the second LED light string in parallel, and when the voltage level of the rectified signal is higher than the second predetermined voltage level, the switch assembly connects the first LED light string and the second LED light string in series.

5. The LED device of claim 4, wherein the switch assembly comprises a first switch, a second switch, and a third switch, when the voltage level of the rectified signal is higher than the first predetermined voltage level and lower than the second predetermined voltage level, the first switch is connected, the second switch is connected, and the third switch is disconnected so that the first LED light string and the second LED light string are connected in parallel, and when the voltage level of the rectified signal is higher than the second predetermined voltage level, the first switch is disconnected, the second switch is disconnected, and the third switch is connected so that the first LED light string and the second LED light string are connected in series.

6. An LED device, for processing a rectified signal from a rectifying module, the rectifying module rectifying a regulated signal and outputting the rectified signal, a phase dimmer cutting a portion of a phase of an input signal and outputting the regulated signal, the LED device comprising:

a first LED light string;

a second LED light string; and a control unit, the control unit receiving the rectified signal, the control unit having a parallel mode and a series mode, the control unit comprising a PWM controller, the PWM controller generating a switching signal based on at least a parameter calculated from the rectified signal;

wherein when the control unit is in the parallel mode, the control unit connects the first LED light string and the second LED light string in parallel, and when the control unit is in the series mode, the control unit connects the first LED light string and the second LED light string in series.

7. The LED device of claim 6, wherein the parameter is a root mean square value calculated from the rectified signal.

8. The LED device of claim 6, wherein the parameter is an average voltage value calculated from the rectified signal.

9. The LED device of claim 6, wherein the PWM controller outputs the switching signal only when the control unit is in the series mode.

10. The LED device of claim 6, wherein the PWM controller outputs the switching signal in both the parallel mode and the series mode.

11. The LED device of claim 6, wherein a duty cycle of the switching signal is the same as a duty cycle of the rectified signal.

12. An LED device, for processing a regulated signal from a phase dimmer, the phase dimmer cutting a portion of a phase of an input signal and outputting the regulated signal, the LED device comprising:

a first LED light string;

a first PWM transistor connected to the first LED light string;

a second LED light string;

a second PWM transistor connected to the second LED light string;

a rectifying module, for rectifying the regulated signal and outputting a rectified signal; and a control unit, the control unit comprising a PWM controller and a voltage input detection unit, the control unit receiving the rectified signal, the PWM controller producing a PWM signal to control the first PWM transistor and the second PWM transistor, the voltage input detection unit comparing the rectified signal with a predetermined voltage level;

wherein when a voltage level of the rectified signal is greater than the predetermined voltage level, the first LED light string and the second LED light string shares the first PWM transistor; and wherein when the voltage level of the rectified signal is lower than the predetermined voltage level, the first LED light string and the second LED light string do not share the first PWM transistor.

13. The LED device of claim 12, wherein the predetermined voltage level is a second predetermined voltage level, the control unit further comprises a switch assembly, when the voltage level of the rectified signal is higher than a first predetermined voltage level and lower than the second predetermined voltage level, the switch assembly connects the first LED light string and the second LED light string in parallel, and when the voltage level of the rectified signal is higher than the second predetermined voltage level, the switch assembly connects the first LED light string and the second LED light string in series.

14. The LED device of claim 13, wherein the control unit further comprises a regulator module for generating a constant current for each of the first LED light string and the second LED light string.

15. The LED device of claim 13, wherein the control unit further comprises a logic circuit for controlling the voltage input detection unit, the switch assembly, and the regulator module.

16. The LED device of claim 12, wherein the PWM controller generates the switching signal based on at least a parameter calculated from the rectified signal.

17. The LED device of claim 16, wherein the parameter is a root mean square value calculated from the rectified signal.

18. The LED device of claim 16, wherein the parameter is an average voltage value calculated from the rectified signal.

19. The LED device of claim 12, wherein a duty cycle of the switching signal is the same as a duty cycle of the rectified signal.

20. The LED device of claim 12, wherein the second PWM transistor is turned off when the voltage level of the rectified signal is greater than the predetermined voltage level.

* * * * *